US007503789B2

(12) United States Patent
Lalonde

(10) Patent No.: US 7,503,789 B2
(45) Date of Patent: Mar. 17, 2009

(54) OPTICAL PACKAGE ALIGNMENT AND TEST MODULE

(75) Inventor: Andre Lalonde, Allen, TX (US)

(73) Assignee: Finisar Corporation, Sunnyvale, CA (US)

( * ) Notice: Subject to any disclaimer, the term of this patent is extended or adjusted under 35 U.S.C. 154(b) by 500 days.

(21) Appl. No.: 11/214,647

(22) Filed: Aug. 30, 2005

(65) Prior Publication Data

US 2006/0046550 A1 Mar. 2, 2006

Related U.S. Application Data

(60) Provisional application No. 60/605,461, filed on Aug. 30, 2004.

(51) Int. Cl.
*H01R 11/22* (2006.01)

(52) U.S. Cl. ..... 439/268; 439/656

(58) Field of Classification Search ..... 439/268, 439/656; 385/88–93; 257/98, 81; 372/36
See application file for complete search history.

(56) References Cited

U.S. PATENT DOCUMENTS 3,518,614 A * 6/1970 Nyberg ..... 439/268
2002/0119692 A1* 8/2002 Burton ..... 439/346

* cited by examiner

*Primary Examiner*—Briggitte R Hammond
*Assistant Examiner*—Vanessa Girardi
(74) *Attorney, Agent, or Firm*—Workman Nydegger

(57) ABSTRACT

A test module for establishing a releasable electronic connection to at least one radially arranged electrical lead of an electronic component is disclosed. The test module can include an elongate housing having a distal end and a proximal end, and a set of pivotal contact clamps for establishing a releasable electrical connection to the leads of an electrical component located at the proximal end of the elongate housing. The leads of the electrical component are radially arranged about a center point of the electrical component and at least one lead is located at a different radial distance from the center point of the electrical component.

21 Claims, 6 Drawing Sheets

OPTICAL PACKAGE ALIGNMENT AND TEST MODULE

CROSS-REFERENCE TO RELATED APPLICATIONS

This application claims the benefit of U.S. Provisional Patent Application No. 60/605,461 entitled "Zero Insertion Force TO-Can Package Alignment and Test Module" filed Aug. 30, 2004, the contents of which is hereby expressly incorporated by reference herein.

BACKGROUND OF THE INVENTION

1. The Field of the Invention

This invention relates generally to testing of electronic components. More specifically, exemplary embodiments of the invention concern a test module for providing connection to electrical leads of an electronic component, such as a TO-Can package, where the electrical leads are arranged radially about the center of the electronic component, but can be at different distances from the center.

2. The Relevant Technology

Electronic components are tested at various stages of manufacture and implementation to insure quality control and proper function. One particular area where testing of electronic components is of importance is the testing of fiber optic communication components, such as fiber optic transmission components. Typically test modules for electrically interfacing the leads of an electronic component use pogo pins, which interface the leads at exact locations.

One common telecom-grade laser diode package for fiber optic transmitters is the so-called TO-Can package. The typical TO-Can package has a substantially circular cross section, whereby the electronic leads of the TO-Can package are arranged radially about the center of the bottom of the component. In some instances, however, the radially located electronic leads of the TO-Can package may not be located at the same distance from the center. Typically, TO-Can packages with electrical leads located at different radial distances from the center require different testing modules with exact positioning of pogo pins to accommodate the electrical leads because the leads are located at different distances form the center.

In addition, where a test module uses pogo pins or other press-fit means to provide electrical connection to the electrical leads of a component (e.g. a TO-Can package) there may be a certain amount of damage done to the electrical leads by the insertion force applied to the leads of the component by the testing module. This is especially the case where the electrical leads are very thin and, therefore, particularly prone to deformation. As a result, typical TO-Can test modules require electrical component leads to be much more resilient to deformation then would otherwise be required. In addition, the user of the test module must use much greater care when interfacing an electronic component with a test module to insure proper alignment so that a proper connection is made and damage is not done to the component's electrical leads.

Therefore, what would be advantageous is a test module that accommodates the electrical leads of an electrical component, such as a TO-Can package, that are arranged radially about the center of an electronic component, but at different distances from the center without placing a damaging insertion force on the electrical leads of the electronic component.

BRIEF SUMMARY OF THE INVENTION

A test module for establishing a releasable electronic connection to at least two radially arranged electrical leads of an electronic component is disclosed. The test module can include an elongate housing having a distal end and a proximal end, and a means for establishing a releasable electrical connection to the at least two leads of the electrical component located at the proximal end of the elongate housing, wherein the leads of the electrical component are radially arranged about a center point of the electrical component and at least one lead is located at a different radial distances from the center point of the electrical component.

A TO-Can component test module is disclosed. The test module can include an elongate cylindrical housing having a peripheral wall, an open proximal end, and an open distal end. The test module can also include a locator plate coupled to the proximal end of the housing having a substantially circular cross section defining a center point, the locator plate can include a plurality of insertion slots radially aligned about the center point and extending outward from the center point. The insertion slots can be configured to receive at least two radially aligned electrical leads of a TO-Can component. The radially aligned electrical leads can be located at different radial distances from the center of the TO-Can component. The test module can further include a center post centrally located, and at least partially received inside the distal end of the housing, and a plurality of elongate contact clamps pivotally mounted to the center post and having first and second ends, wherein each of the plurality of contact clamps can be sized and configured to contact an electrical lead from the TO-Can component at different radial distances from the center, and wherein each of the plurality of contact clamps are further configured to receive an engaging force to pivot the second end of the contact clamps into a connected position toward the center post, and further configured to receive a releasing force to pivot the second end of the contact clamps into a released position away the center post. The test module can further include an electrical interface attached to the elongate housing and electrically coupled to the contact clamps, the electrical interface comprising several connection pins providing an electrical interface for connection to the TO-Can package being tested.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to providing electrical connection to the radially arranged electrical leads of an electrical component. More specifically, embodiments of the present invention are concerned with establishing an electrical connection to the electrical leads of a TO-Can package that accommodates leads that are radially arranged around a center point, but may be located at different distances from the center point of the TO-Can package. In addition, embodiments of the present invention are concerned with providing an electrical connection to the leads of a TO-Can package without subjecting the leads to a damaging force during electrical connection with the test module.

The principles of the present invention are described with reference to the attached drawings to illustrate the structure and operation of example embodiments used to implement the present invention. Using the diagrams and description in this manner to present the invention should not be construed as limiting its scope. Additional features and advantages of the invention will in part be obvious from the description, including the claims, or may be learned by the practice of the invention. Detailed descriptions of well-known components and processing techniques are omitted so as not to unnecessarily obscure the invention in detail.

Figure 1:
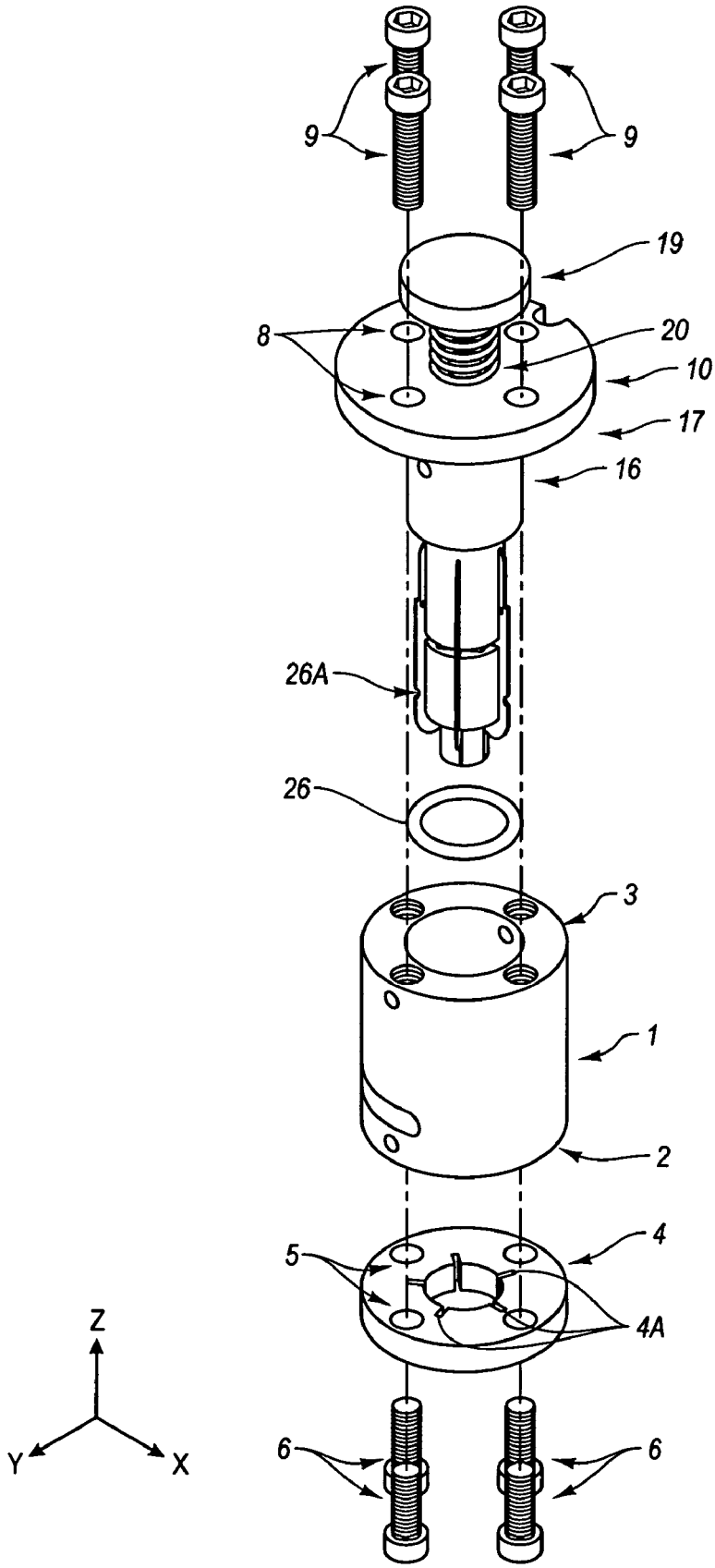
FIG. 1 shows an exploded perspective view of a test module illustrating one embodiment of the present invention.

FIG. 1 shows an exploded perspective view of a test module illustrating one embodiment of the present invention. As shown in FIG. 1, the test module can include a substantially cylindrical housing 1 with an open proximal end 2 and an open distal end 3. The test module can further include a locator plate 4 having a substantially circular cross-section and several insertion slots 4A for receiving electrical leads. The locator plate 4 can include holes 5 for receiving several screws 6 to attach the locater plate 4 to the proximal end 2 of the housing 1. The test module can further include a center post assembly 7 that can be centrally located and partially received within the distal end 3 of the housing 1 when assembled. The center post assembly 7 can include an end portion 10 having several holes 8 for attaching the center post assembly 7 to the distal end 3 of the housing 1 by several screws 9. It should be appreciated, however, that the locator plate 4 and center post assembly 7 may be attached to the housing 1 using any means known to one of skill, such as, but not limited to, adhesive, press fitting, and locating pins. The center post assembly 7 and/or the locator plate 4 can also be manufactured as an integral portion of the module housing 1.

Figure 2:
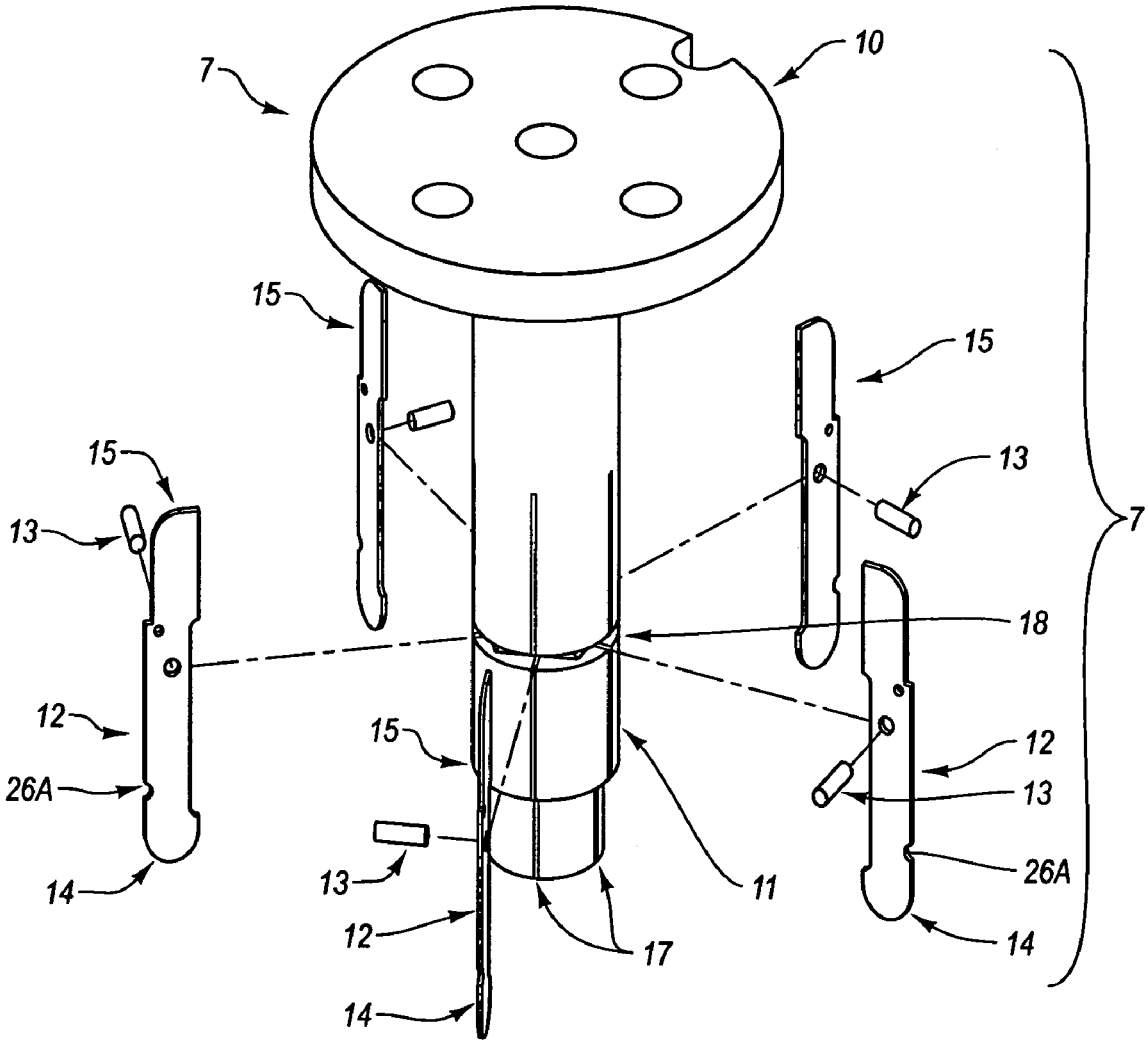
FIG. 2 illustrates an example means for establishing releasable electrical connection to the leads of an electrical component.

Referring now to FIG. 2, an example means for establishing releasable electrical connection to the leads of an electrical component is shown in an exploded perspective view. As shown in FIG. 2, the center post assembly 7 can comprise an end portion 10 with a substantially larger diameter than a shaft portion 11. A plurality of contact clamps 12 are shown with corresponding pivot dowels 13 for pivotally mounting the contact clamps 12 to a transverse pivot grove 18 such that the contact clamps 12 may pivot about the pivot dowels 13. Each contact clamp 12 has a first end 14 for contacting an electrical lead of a TO-Can package and a second end 15. Several longitudinal grooves 17 are located along the center post shaft portion 11 for recessing a corresponding contact clamp 12 within the outer diameter of the shaft portion 11 of the center post assembly 7, thereby allowing the ends of the contact clamps 12 to pivot within their respective groove 17.

Figure 3:
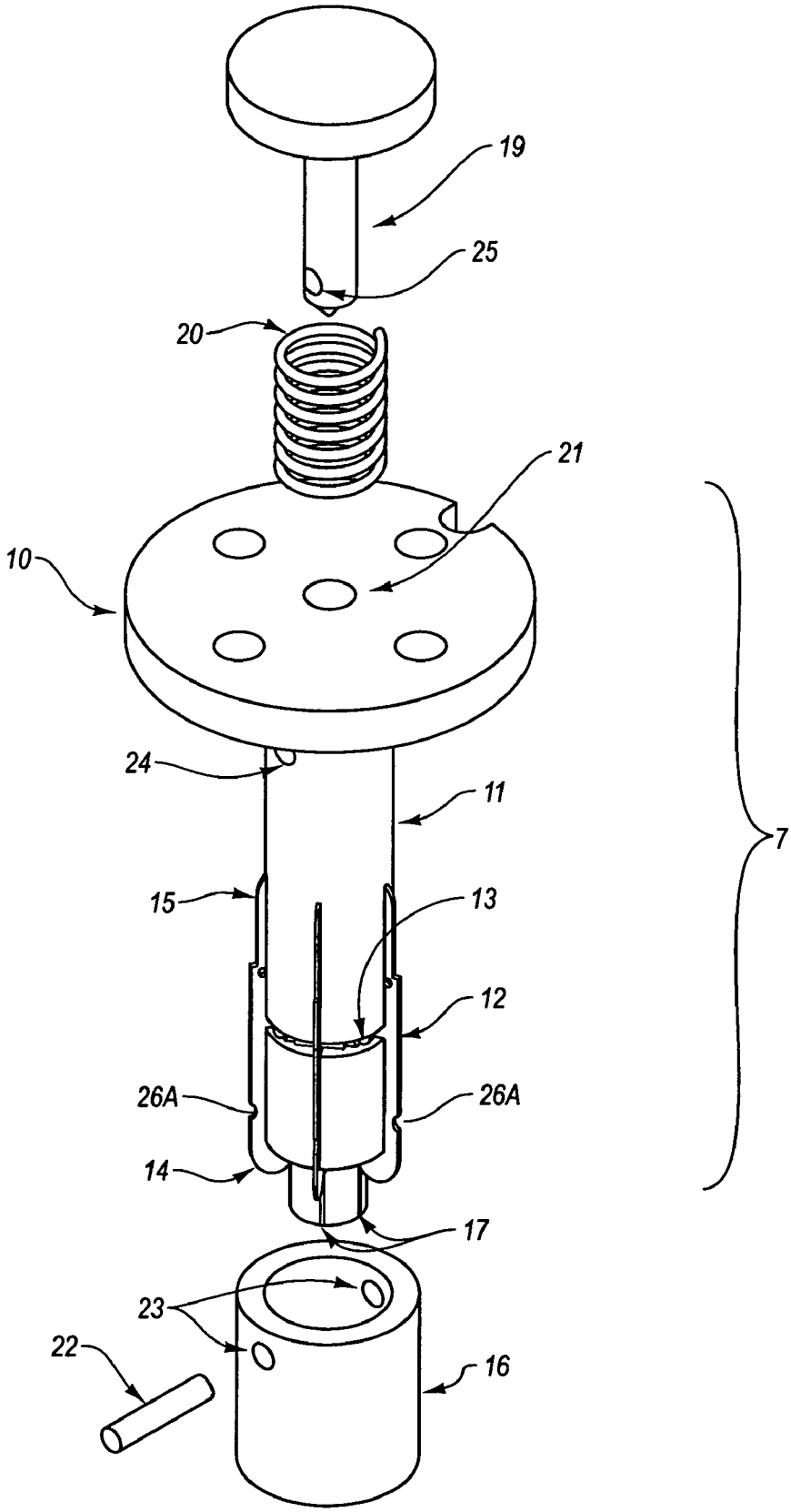
FIG. 3 illustrates an example means for releasing the contact clamps 12 from a connected position.

With cross-reference to FIGS. 1 and 3, an O-ring 26 can be placed around the contact clamps 12 at the notch 26A near the first end 14 of the contact clamps 12 providing a biasing force urging the first end 14 of the contact clamps 12 to pivot inward toward a connected position toward the center of the shaft portion 11. The force provided by the O-ring 26 places the contact clamps 12 in a normally connected position where the first end 14 of the contact clamps 12 are pivoted toward the center of the shaft portion 11 without application of a force that opposes the force applied by the O-ring 26.

Referring now to FIG. 3, an exploded perspective view of an example means for releasing the contact clamps 12 from a connected position is shown. As shown, the contact clamps 12 can be pivotally coupled to the shaft portion 11 of the center post assembly 7 by a pivot dowel 13 and recessed into the contact clamp grooves 17. A cam plunger 19, spring 20, clamping cam 16, and cam dowel 13 can be provided for releasing the contact clamps 12 from the connected position toward the center of the shaft portion 11. A center hole 21 can be provided in the end portion 10 of the center post assembly 7. The center hole 21 extends through the end portion 10 of the center post assembly 7 and into the shaft portion 11. When assembled, the cam plunger 19 can be inserted into the center hole 21 and connected to the clamping cam 16 by a cam dowel 22. The cam dowel 22 can extend through two holes 23 in the upper portion of the clamping cam 16, through several longitudinal slots 24 in the shaft portion 11, and through a hole 25 in the tip of the cam plunger 19. The clamping cam 16 can be biased in the same outward direction as the cam plunger 19 as a result of the clamping cam 16 being coupled to the cam plunger 19 by the cam dowel 22, which is biased into an outward position by the spring 20.

It should be appreciated that other structures and variations may be used for establishing and releasing the test module from electrical connection with the leads of an electrical component. For example, levers, buttons, solenoids and other mechanical and electrical means of actuation may be used according to example embodiments of the present invention. The specific structure described herein is merely illustrative of example embodiments within the scope of the invention.

Figure 4:
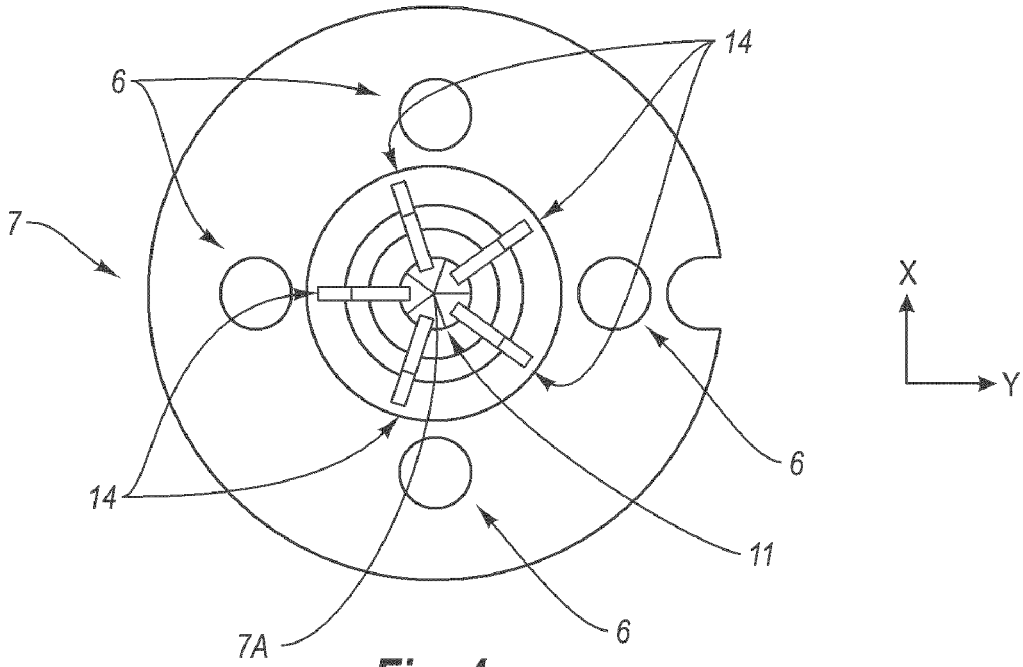
FIG. 4 illustrates a position for receiving leads of an electronic component.
Figure 5:
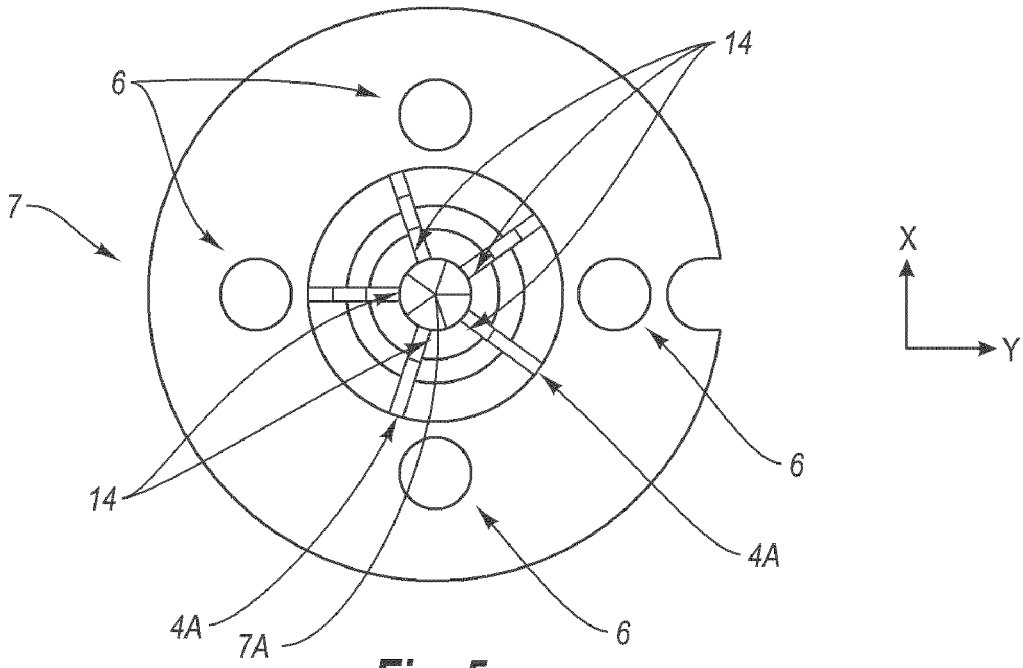
FIG. 5 illustrates a position for contracting the leads of an electronic component.

With cross-reference to FIGS. 3, 4, and 5, FIGS. 4 and 5 are bottom views as seen from the proximal end 5 of the test module along the Z axis. FIG. 4 illustrates a disconnected position for receiving leads of an electronic component. FIG. 5 illustrates a connected position for contracting the leads of an electronic component. The module can typically in the connected position depicted by FIG. 5 where the first end 14 of the contact clamps 12 are pivoted toward the center of the shaft portion 11. In order to insert the leads of a TO-Can component, the cam plunger 19 can be depressed against the bias force of the spring 20 causing the clamping cam 16 to move downward across the shaft portion 11 of the center post assembly 7 and engage the second end 15 of the contact clamps 12. The force of the clamping cam 1 against the second end 15 of the contact clamps 12 causes the second end 15 of the contact clamps 12 to pivot inward toward the center of center post assembly 7 thereby causing the first end 14 of the contact clamps 12 to pivot away from the center of the center post assembly 7 into the disconnected position shown in FIG. 4. In this disconnected position, a space is created as shown in FIG. 4 for receiving the leads of a TO-Can component at various distances form the center of the TO-Can component.

The illustrations shown in FIGS. 4 and 5 depict an embodiment including five contact clamps 12 for contacting the leads of a TO-Can component with five electrical leads or less located at the radial positions of the test module. Other embodiments of the present invention include test modules with different numbers of contact clamps 12 for contacting the leads of a TO-Can with a different number of leads. The test module can include any number of contact claims (e.g. 2-10 contact lcamps) for contacting any number of radially arranged contacts of an electrical component. These contact clamps, and the insertion slots 5 need not be radially symmetrical either or have the exact shapes illustred. For example the contact clams 12 and the insertion slots 5 can be located at different relative distances and radial angles for receiving radially arranged leads of electronic components that are arranged at any angular position about a center point 7A and at any distance from the center point 7A of the electrical component including different relative angles about the center point 7A and different distances from the center point 7A.

FIGS. 4 and 5 illustrate one embodiment of the present invention where the insertion slots 4A are all about the same size and contacts 14 are all about the same size. Also, according to the embodiment shown in FIGS. 4 and 5, both the insertion slots 4A and the contacts 14 and can be arranged substantially symmetrically about the center point 7A of the proximate end 2. It should be appreciated that the insertion slots 4A and contacts 14 are illustrated in such fashion for purposes of understanding the present invention and should not be limiting in scope. Other configurations where the insertion slots 4A and contacts 14 are of different relative size and located at different relative locations about the center point 7A and distances from the center point 7A are considered included within the scope of several example embodiments of the present invention in view of this disclosure.

Once the TO-Can has been placed flat against the locater plate 4 with the TO-Can leads extending into the space between the contact clamps 14 and the shaft portion 11 of the center post assembly 7, the pressure applied to the cam plunger 19 can be released. The force applied by the spring 20 to the cam plunger 19 causes the clamping cam 16 to move upwards and disengage the second end 15 of the contact clamps 12 allowing the contact clamps 12 to pivot into the connected position shown in FIG. 5 under the force applied to the contact clamps 12 by the O-ring 26 causing the contract clamps 12 to electrically engage the leads of the TO-Can component thereby creating an electrical connection between the contact clamps 14 and the leads of the TO-Can component.

To release the leads of the TO-Can package from electrical connection with the contacts 12 of the test module, a force can be applied to the cam plunger 19 thereby moving the cam plunger 19 against the bias force of the spring 20 and causing the clamping cam 16 to move downward across the shaft portion 11 of the center post assembly 7 and engage the second end 15 of the contact clamps 12. The force of the clamping cam 16 against the second end 15 of the contact clamps 12 causes the first end 14 of the contact clamps 12 to pivot outward from the center of the shaft portion 11 back into a disconnected position as shown in FIG. 4 thereby releasing the electrical leads of the TO-Can component from electrical connection with the contact clamps 14 and allowing for removal of the electrical leads from the test module.

Figure 6:
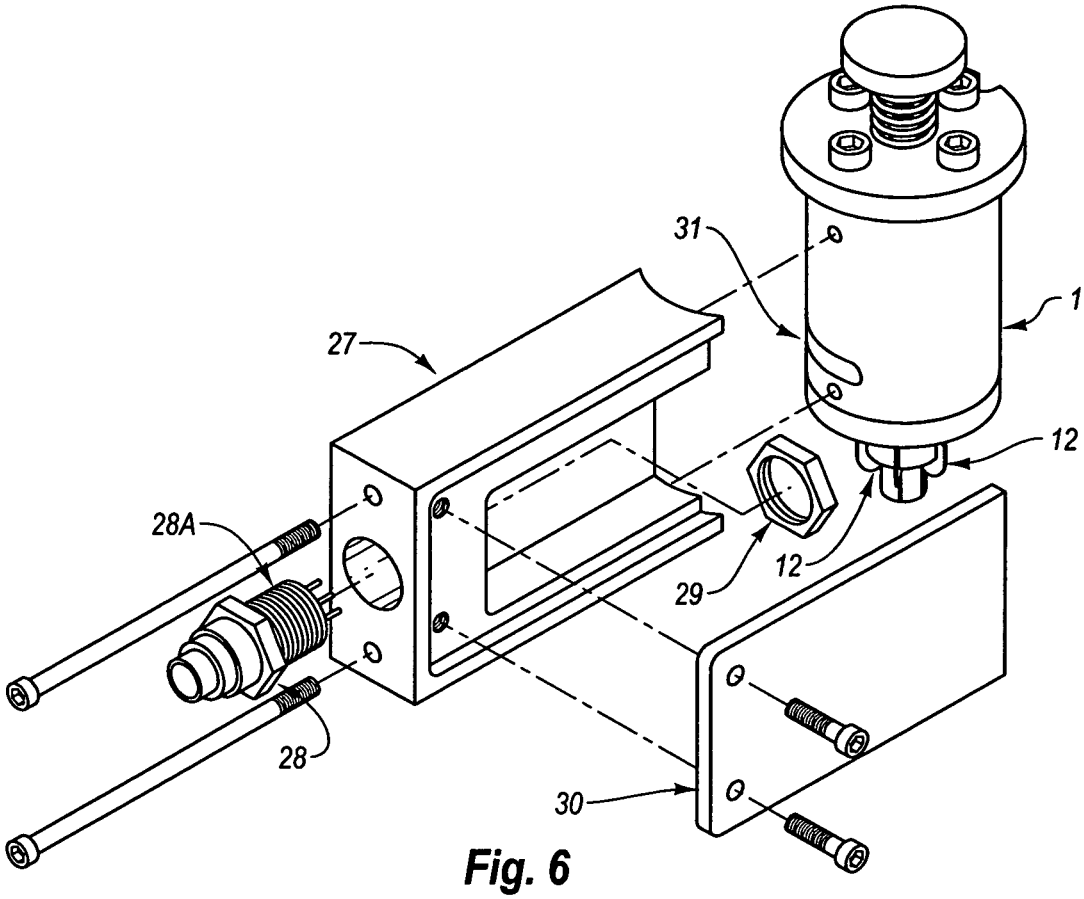
FIG. 6 illustrates an example interface and interface mount for mounting the interface to a side of the test module.

Referring now to FIG. 6, an example interface 28 and interface mount 27 are shown for mounting the interface 28 to the side of the test module housing 1. As shown in FIG. 6, the interface 28 may be attached to the interface mount 27 using threads 28A about the outer surface of the interface 28 along with a corresponding nut 29 to mount the interface 28 to the interface mount 23. An access door 30 may also be attached to the interface mount 27 to allow access to the wire connections of the interface 28. An access hole 31 can be provided in the side of the housing 1 allowing for wires connected to the contact clamps 12 to travel through the hole 31, into the interface mount 27, and to the interface 28, thereby allowing for electrical connection between the interface 28 and the contact clamps 12.

Figure 7:
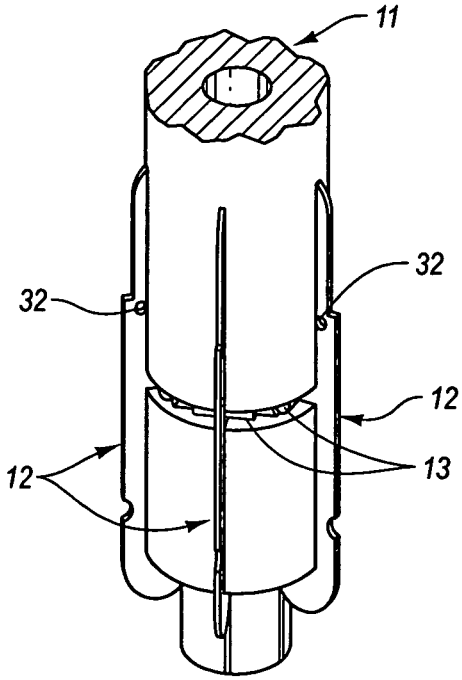
FIG. 7 is a partial illustration showing an example of how electrical connection can be established with the contact clamps.

Referring now to FIG. 7, a partial illustration showing the shaft portion 11 of the center post assembly 7 and several contact clamps 12 pivotally mounted to the shaft portion 11 of the center post assembly 7 by the pivot dowels 13 is shown. Each of the contact clamps 12 can include a solder point hole 32 for coupling (e.g. by soldering) a wire in electrical connection with the contact clamp 12.

Figure 8:
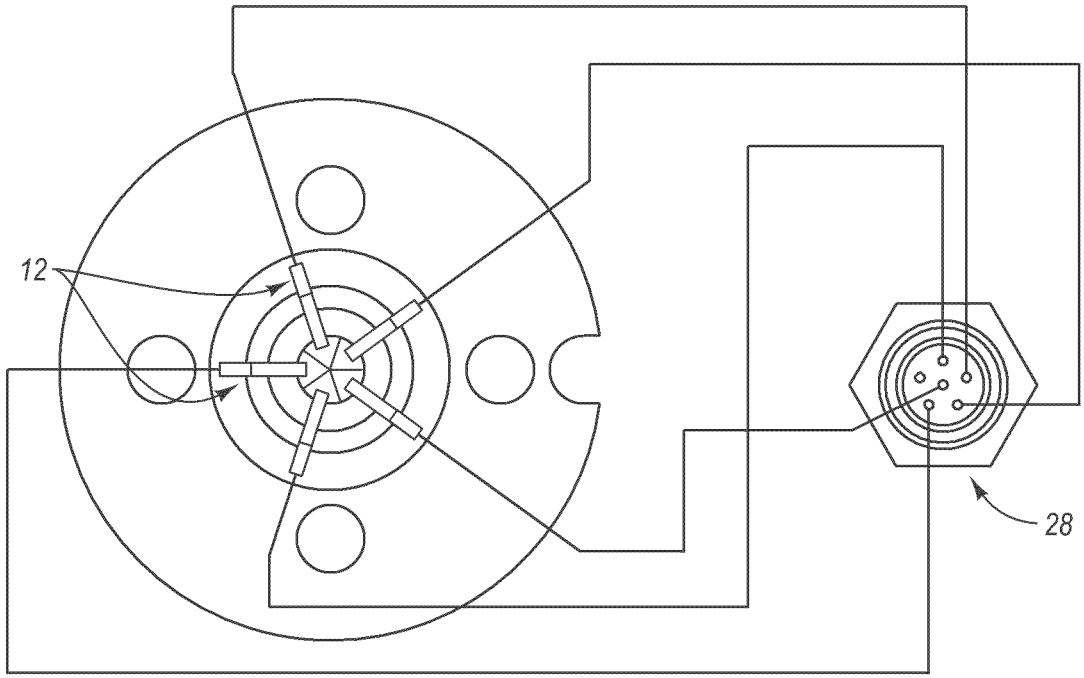
FIG. 8 is an example illustration of the wiring between the interface and the contact clamps of the test module.

Referring now to FIG. 8 an example illustration of the wiring between the interface 28 and the contacts 12 of the test module is shown. As illustrated in FIG. 8, wires can be soldered to each of the contact clamps 12 electrically coupling the contact clamps 12 to a corresponding pin of the electrical interface 28.

Figure 9:
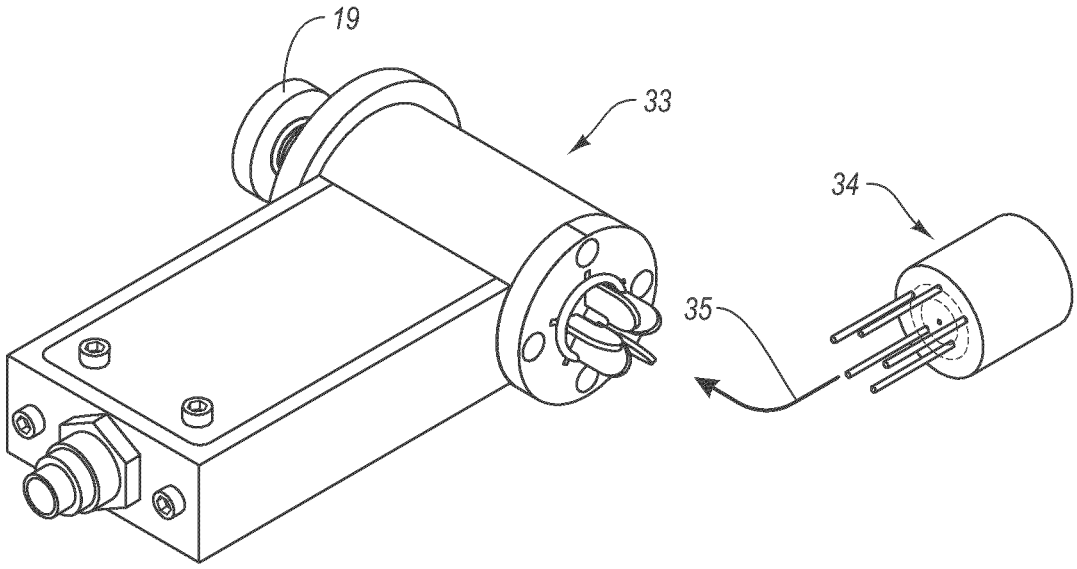
FIG. 9 is an operational perspective view of an assembled test module and a TO-Can component.

FIG. 9 is an operational perspective view of an assembled test module 33 and a TO-Can component 34. An arrow 35 is shown illustrating the direction of insertion of the electrical leads of the TO-Can component 34 into the end of the test module 33 once the test module 33 is placed in the disconnected position by depressing the cam plunger 19.

The invention may be embodied in other specific forms without departing from its spirit or essential characteristics. The described example embodiments and specific features are to be considered in all respect only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A test module establishing a releasable electronic connection to at least two radially arranged electrical leads of an electronic component, the test module comprising:

an elongate housing comprising:

a distal end;

a proximal end; and means located at and at least partially extending outside the proximal end of the elongate housing for establishing a releasable electrical connection to the at least two leads of the electrical component, wherein the leads of the electrical component are radially arranged about a center point of the electrical component, and wherein at least one of the electrical leads is located at a different radial distance from the center point of the electrical component than the other electrical leads.

2. The test module of claim 1, wherein the electronic component comprises an optical package.

3. The test module of claim 1, wherein the electronic component comprises a TO-Can package.

4. The test module of claim 1, wherein the releasable connection means comprises a plurality of releasable contact clamps at least partially received within the proximal end of the test module housing, wherein each releasable contact clamp is configured to contact one of the radially arranged electrical component leads that is located at a different radial distance from the center point.

5. The test module of claim 4, further comprising a locator plate coupled to the proximal end, the locator plate comprising a plurality of insertion slots radially arranged about a center point of the locator plate, wherein each insertion slot is aligned with one of the releasable contact clamps, and wherein the insertion slots are configured to receive the radially arranged set of electrical component leads that are located at different distances from the center point.

6. The test module of claim 5, wherein the locator plate is either integral with the housing or attached to the housing.

7. The test module of claim 5, wherein at least two releasable contact clamps and at least two insertion slots are located at different angular positions about the center point of the locator plate.

8. The test module of claim 5, wherein the test module comprises at least two contact clamps and at least two insertion holes.

9. The test module of claim 5, wherein the insertion slots and contact clamps are configured such that substantially no insertion force is applied to the electrical leads of a TO-Can component upon insertion or removal of the electrical leads from the test module.

10. The test module of claim 5, wherein at least two releasable contact clamps and two insertion slots are located at different distances from the center point of the locator plate.

11. The test module of claim 10, wherein the releasable contact clamps are pivotally coupled to the test module to pivot into a connected position, and further configured to pivot out of the connected position and into a disconnected position.

12. The test module of claim 11, wherein each releasable contact clamp includes a solder point hole for coupling a wire in electrical connection with the contact clamp, wherein each wire is also coupled to an interface in electrical connection.

13. The test module of claim 4, further comprising means for releasing the plurality of releasable contact clamps from a connected position.

14. The test module of claim 13, wherein the releasing means comprises:

a clamping cam having a substantially tubular shape;

a spring; and a plunger having the spring substantially surrounding a portion of the plunger, wherein upon application of a force to the plunger against a biasing force applied to the plunger by the spring the clamping cam applies a biasing force against a second end of each releasable electrical contact clamp thereby pivoting each releasable electrical contact clamp out of an engaged position and into a disengaged position.

15. The test module of claim 14, wherein the test module comprises between 2 and 10 contact clamps for coupling to between 2 and 10 electrical leads of the electronic component, wherein the electrical leads of the electronic component can be located at different radial distances from the center point of the electronic component.

16. A test module for establishing a releasable electronic connection to at least two radially arranged electrical leads of an electronic component, the test module comprising:

an elongate housing comprising:

a distal end;

a proximal end; and means located at the proximal end of the elongate housing for establishing a releasable electrical connection to the at least two leads of the electrical component, wherein the leads of the electrical component are radially arranged about a center point of the electrical component, and wherein at least one of the electrical leads is located at a different radial distance from the center point of the electrical component than the other electrical leads;

wherein the releasable connection means comprises a plurality of releasable contact clamps at least partially received within the proximal end of the test module housing, wherein each releasable contact clamp is configured to contact one of the radially arranged electrical component leads that is located at a different radial distance from the center point; and means for releasing the plurality of releasable contact clamps from a connected position, wherein the releasable electrical contact clamps are biased in the connected position by an O-ring extending around a first end of the releasable contact clamps.

17. A TO-Can component test module comprising:

an elongate cylindrical housing having a peripheral wall, an open proximal end, and an open distal end;

a locator plate coupled to the proximal end of the housing having a substantially circular cross section defining a center point;

the locator plate comprising a plurality of insertion slots radially aligned about the center point and extending outward from the center point, wherein the insertion slots configured to receive radially aligned electrical leads of a TO-Can component, the radially aligned electrical lead being located at different radial distances from the center of the TO-Can component;

a center post centrally located, and at least partially received inside the distal end of the housing; and a plurality of elongate contact clamps pivotally mounted to the center post and having first and second ends, wherein each of the plurality of contact clamps are sized and configured to contact an electrical lead from the TO-Can component at different radial distances from the center, and wherein each of the plurality of contact clamps are further configured to receive an engaging force to pivot the second end of the contact clamps into a connected position toward the center post, and wherein each contact clamp is further configured to receive a releasing force to pivot the second end of the contact clamps into a released position away from the center post.

18. The test module of claim 17, further comprising:

an electrical interface attached to the elongate housing and electrically coupled to the contact clamps, the electrical interface comprising several connection pins providing an electrical interface for connection to the TO-Can package being tested.

19. The test module of claim 17, wherein the insertion slots and contact clamps are configured such that substantially no insertion force is applied to the electrical leads of the TO-Can component upon insertion or removal of the electrical leads from the test module.

20. The test module of claim 17, further comprising:

a clamping cam having a substantially tubular shape;

a spring; and a plunger coupled to the clamping cam and having the spring substantially surrounding a portion of the plunger, wherein upon application of a force to the plunger against a biasing force applied to the plunger by the spring the clamping cam applies a the releasing force against a second end of each releasable electrical contact thereby pivoting each releasable electrical contact out of an engaged position and into a disengaged position.

21. The test module of claim 17, wherein the test module comprises a least two contact clamps located at different distances from the center point and two insertion holes located at different distances from the center point.

* * * * *